US007363725B2

(12) United States Patent
Promitzer et al.

(10) Patent No.: US 7,363,725 B2
(45) Date of Patent: Apr. 29, 2008

(54) DEVICE FOR DRYING PAPER WEBS, ESPECIALLY TISSUE PAPER WEBS

(75) Inventors: Wolfgang Promitzer, Graz (AT); Johann Hiebaum, Kalsdorf (AT)

(73) Assignee: Andritz AG, Graz (AT)

( * ) Notice: Subject to any disclaimer, the term of this patent is extended or adjusted under 35 U.S.C. 154(b) by 992 days.

(21) Appl. No.: 10/392,460

(22) Filed: Mar. 19, 2003

(65) Prior Publication Data

US 2003/0177660 A1 Sep. 25, 2003

(30) Foreign Application Priority Data

Mar. 19, 2002 (AT) ..... A 411/2002

(51) Int. Cl.
*F26B 11/02* (2006.01)

(52) U.S. Cl. ..... 34/120; 34/122

(58) Field of Classification Search ..... 34/122, 34/117, 120, 121

See application file for complete search history.

(56) References Cited

U.S. PATENT DOCUMENTS 5,531,033 A * 7/1996 Smith et al. ..... 34/117
6,079,115 A 6/2000 Ringer et al.

* cited by examiner

*Primary Examiner*—Patricia Bianco
*Assistant Examiner*—Camtu Nguyen
(74) *Attorney, Agent, or Firm*—Alix, Yale & Ristas, LLP

(57) ABSTRACT

The invention relates to a device for drying paper webs, especially tissue paper webs, with a dryer cylinder 1 and a dryer hood 2, 3 for blowing hot air onto the paper web. It is mainly characterised by the inlet air parts of the dryer hood 2, 3, such as the nozzle basket 9 or the inlet duct 4, being uncoupled from the frame or hood structure 10. This is especially advantageous at operating temperatures of up to 700° C.

5 Claims, 6 Drawing Sheets

DEVICE FOR DRYING PAPER WEBS, ESPECIALLY TISSUE PAPER WEBS

BACKGROUND OF THE INVENTION

The invention relates to a device for drying paper webs, especially tissue paper webs, with a dryer cylinder and a dryer hood for blowing hot air onto the paper web.

These systems are also called Yankee cylinders (dryers) and Yankee hoods and have been used in the area of tissue production for a long time. High impingement temperatures of the hot air are required in order to achieve high throughput and good quality. Currently, dryer hoods working at temperatures of up to approx. 500° C. are in operation, with limitations that are due primarily to the materials. There are drawbacks, caused especially also by different gaps between the dryer cylinder and the dryer hood during operation, leading to non-uniform drying.

SUMMARY OF THE INVENTION

The aim of the invention is therefore to provide a device for efficient, uniform drying of a paper web, especially a tissue paper web, at high temperatures.

According to the invention this is achieved by uncoupling the inlet air parts of the dryer hood, such as the nozzle basket or the inlet duct, from the frame or hood structure. This uncoupling e.g., flexible connection, makes free movement of the hot parts, like the nozzle basket and the inlet duct, possible.

If the nozzle basket is pivotably mounted at an upper point in the frame, then the nozzle basket can move freely while it warms up and cools off, and no stresses are created.

If the nozzle basket is supported for sliding at a lower point of the hood frame, with the lower support point possibly being optionally adjustable, a uniform and optionally adjustable gap can be achieved between the cylinder and the hood.

If the frame and the nozzle basket are fixed advantageously at different sides (drive side and front side, respectively) perpendicular to the paper web, expansion perpendicular to the paper web can be minimized.

If an additional adjustment option for the gap between the dryer cylinder and the dryer hood is to be achieved in operation, a drive unit and a gap sensor are provided according to the invention.

It is particularly advantageous for the gap between the dryer hood and the dryer cylinder to be essentially uniform at all points at high impingement temperatures in operation, especially above 550° C., and for instance up to 700° C.

BRIEF DESCRIPTION OF THE DRAWINGS

The preferred embodiment of the invention will be described below with reference to the accompanying drawings, where.

DESCRIPTION OF THE PREFERRED EMBODIMENT

Figure 1:
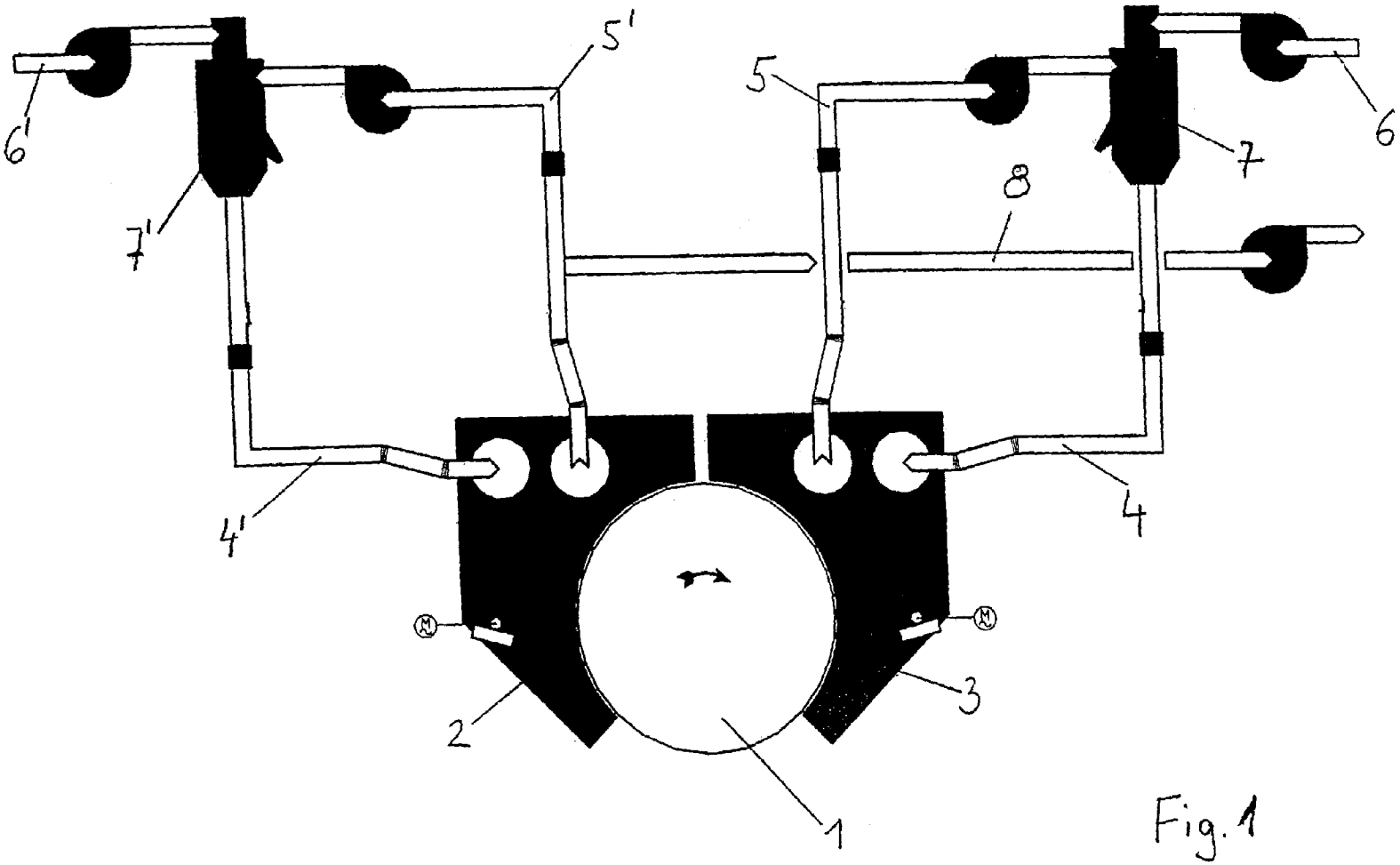
FIG. 1 shows a schematic overview of a dryer with dryer cylinder and dryer hood.

FIG. 1 shows the schematic construction of a drying system for paper, especially tissue paper as viewed from the front side (with the drive side at the opposite axial end). The paper web is guided around a dryer cylinder 1, which is partially wrapped or enveloped by a first hood half 2 and a second hood half 3. Hot air from a duct 4, 4' is blown through the hoods onto the paper. The cooled-off air is discharged through a duct 5, 5'. Currently, the hot air temperatures are between 300° C. and 500° C., which gives a water evaporation of approximately 90 $kg_w/m^2h$ and 160 $kg_w/m^2h$, respectively. The goal is, however, to increase the impingement temperature to 600° C. and 700° C., respectively, which gives water evaporation rates of over 200 $kg_w/m^2h$. At these high temperatures, however, undesired geometric relationships arise as the hood expands under the heat. Thus, the gap between dryer cylinder 1 and hood 2, 3 changes to the extent that larger gaps are created at the lower end, while at the upper end, the hood parts 2, 3 may grind against cylinder 1 and may damage both the paper web and the cylinder 1.

Figure 2:
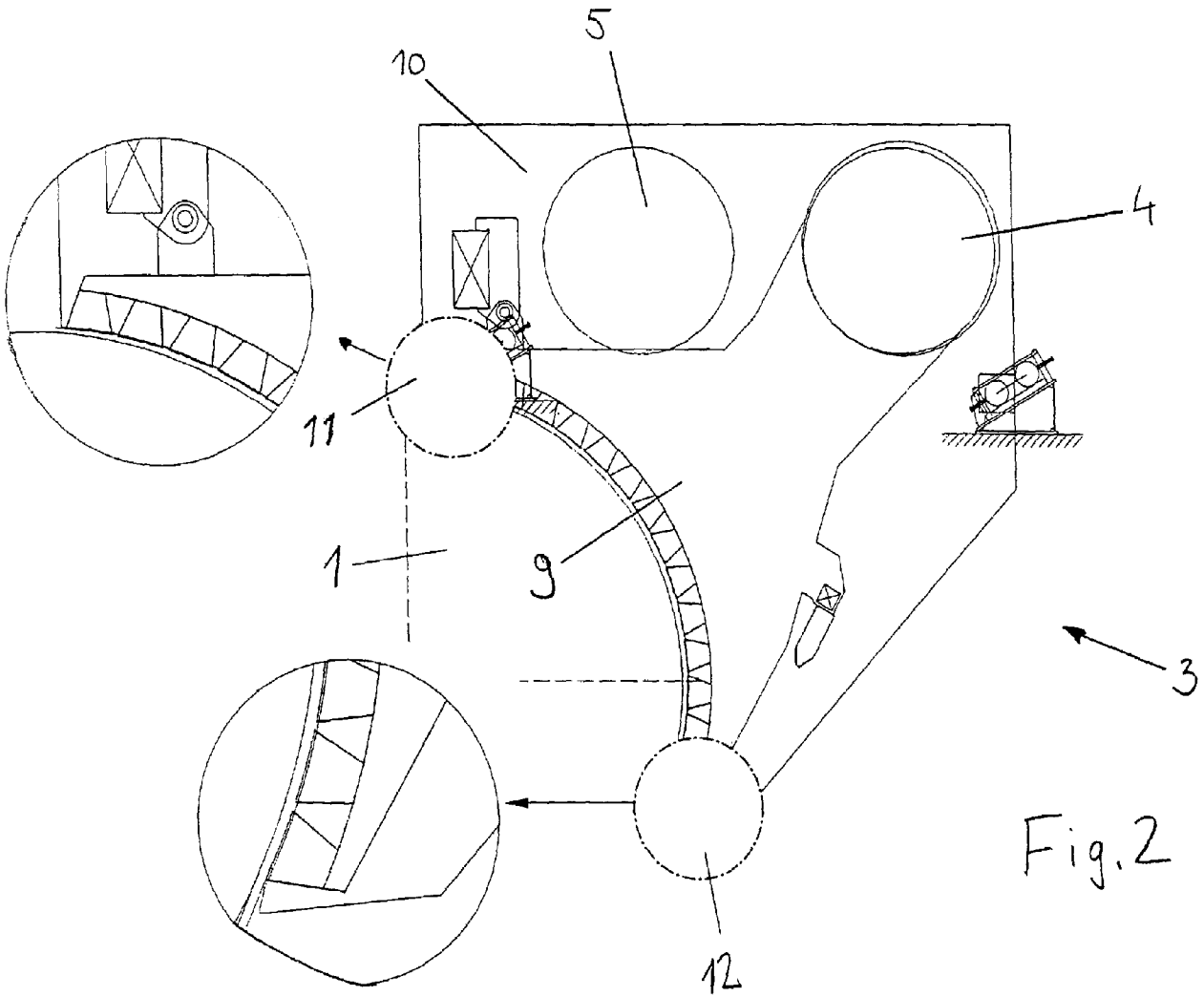
FIG. 2 shows one hood half in the cold state.

FIG. 2 shows the second hood half 3 of a dryer system. Hot air duct 4 leads into nozzle basket 9 and, through a number of nozzles, flows onto the paper running around the dryer cylinder 1. Hood frame 10 surrounds the nozzle basket 9. As used herein, "hood" should be understood as including structures rigidly connected to the overall hood frame. When nozzle basket 9 and hood structure 10 are in a cold state, the gap at the crown 11 of the hood is smaller than the gap at the hood end 12, in order to achieve the best possible gap between the hood and the cylinder in operation.

Figure 3:
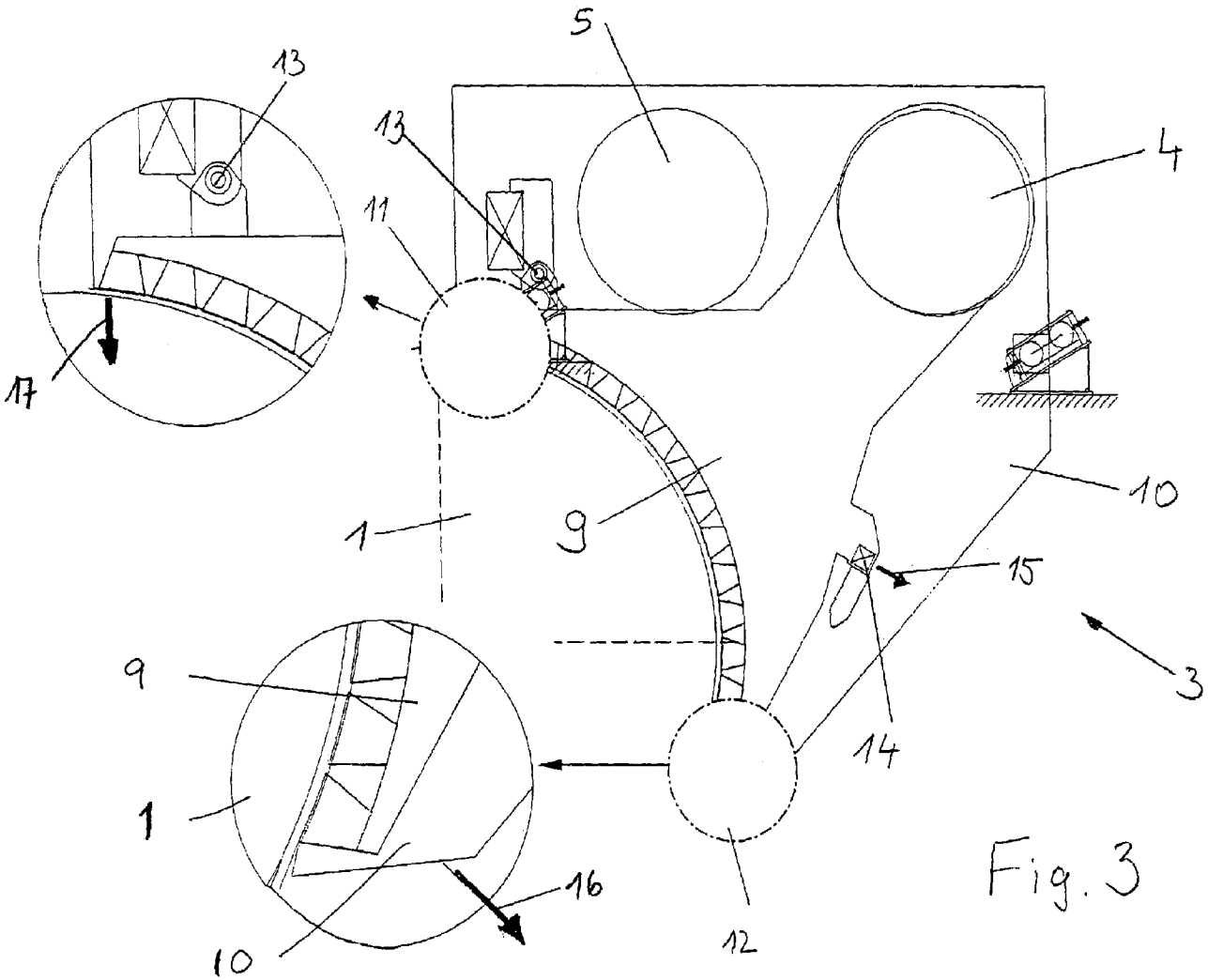
FIG. 3 shows a hood half analogous to FIG. 2 but with hot nozzle basket.

The expansion under heat is shown in FIG. 3, with the nozzle basket 9 during the starting operation being the first to heat up to approx. 600-700° C. The upper limit for this is set by the material qualities of the metal sheets used. To make safe expansion possible and to avoid heat stresses as far as possible, nozzle basket 9 and hood structure 10 are uncoupled according to the invention. In the area of the hood crown 11, nozzle basket 9 is supported pivotably in a bearing 13 at the main support of the hood structure 10. In the lower hood area, nozzle basket 9 glides on a further bearing 14. As a result, the nozzle basket when it is heated moves in the direction of arrows 15 (gliding along bearing 14), along arrow 16 at the lower end 12 in the direction away from cylinder 1 and arrow 17 at the upper end 11 slightly toward cylinder 1.

Figure 4:
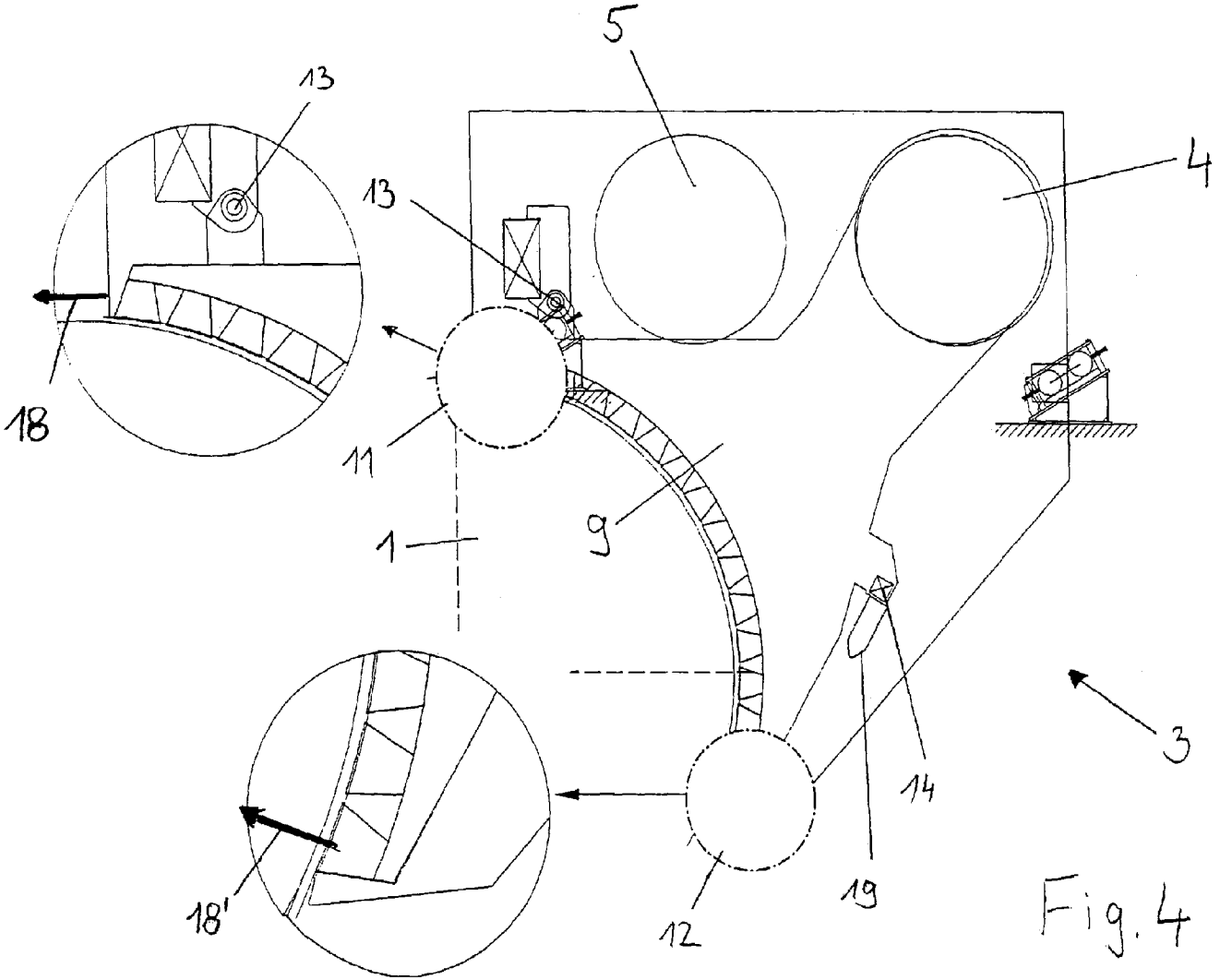
FIG. 4 shows an analogous view with hot hood half and hot hood frame.

FIG. 4 shows the state in which the hood structure 10 also heats up. The upper bearing 13 is displaced in the direction of arrow 18, i.e. toward the other hood half. This means that the gap between the hood and the cylinder becomes larger again. In the lower area 12, the entire hood half 3 is displaced in direction 18', so that here the gap recedes. To adjust the gap between the hood and the cylinder optimally, the sliding bearing 14 is arranged slideably and/or adjustably in a slot 19. If a drive is provided here, the gap can be adjusted optimally at any moment in operation.

Figure 5:
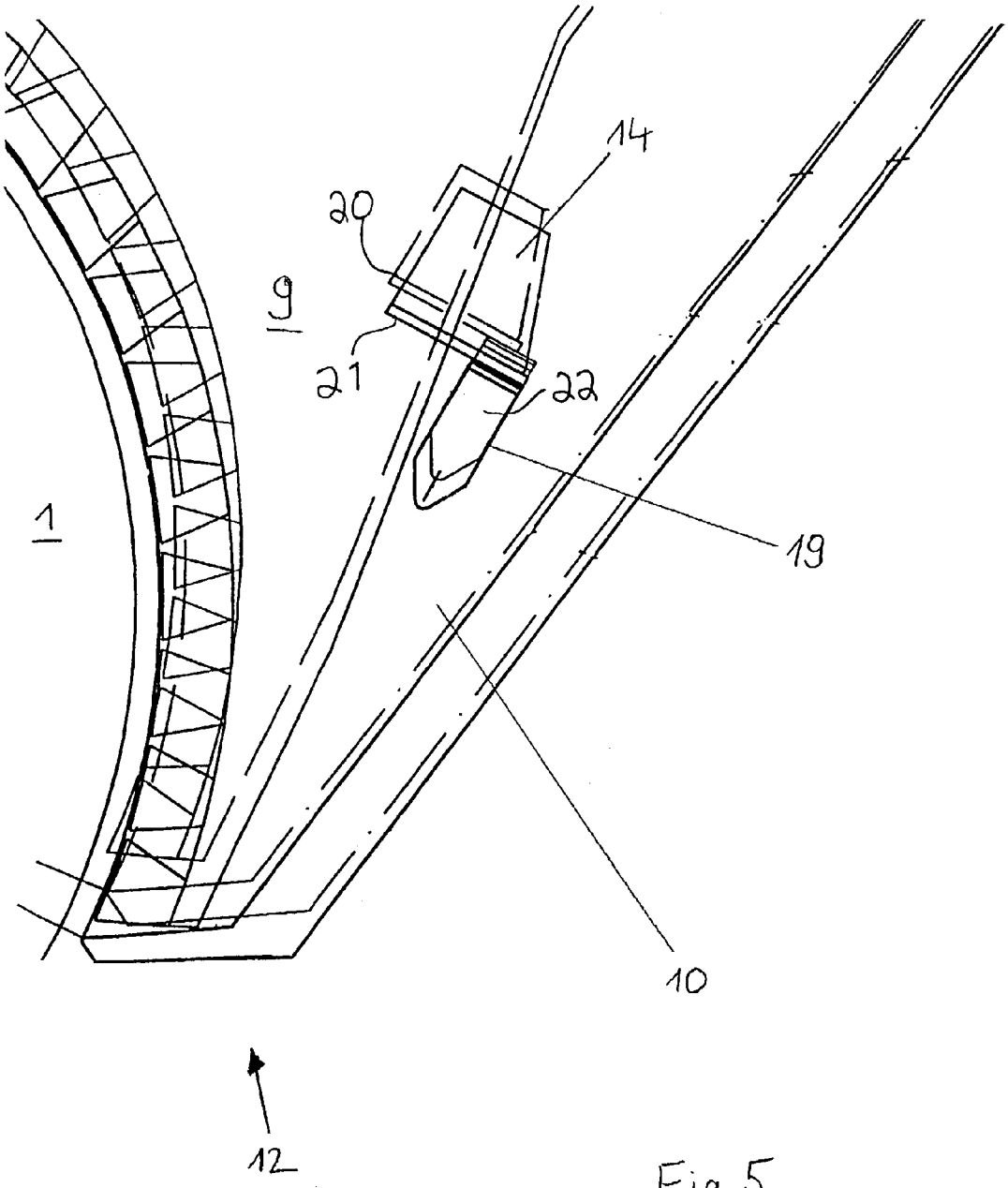
FIG. 5 shows the area of a support for the hood.

FIG. 5 shows the adjustability in greater detail, with different positions having been entered, which result especially from the expansion under heat. The full lines show the state at operating temperature, while the broken lines show the cold state. The lower bearing 14, which has a sliding design, of the nozzle basket 9, is particularly clearly visible in this figure. Bearing 14 has a lower flange 20 with a flat bottom surface 21 which is slidably carried on support 22 which is slideable and/or adjustable in slot 19.

Figure 6:
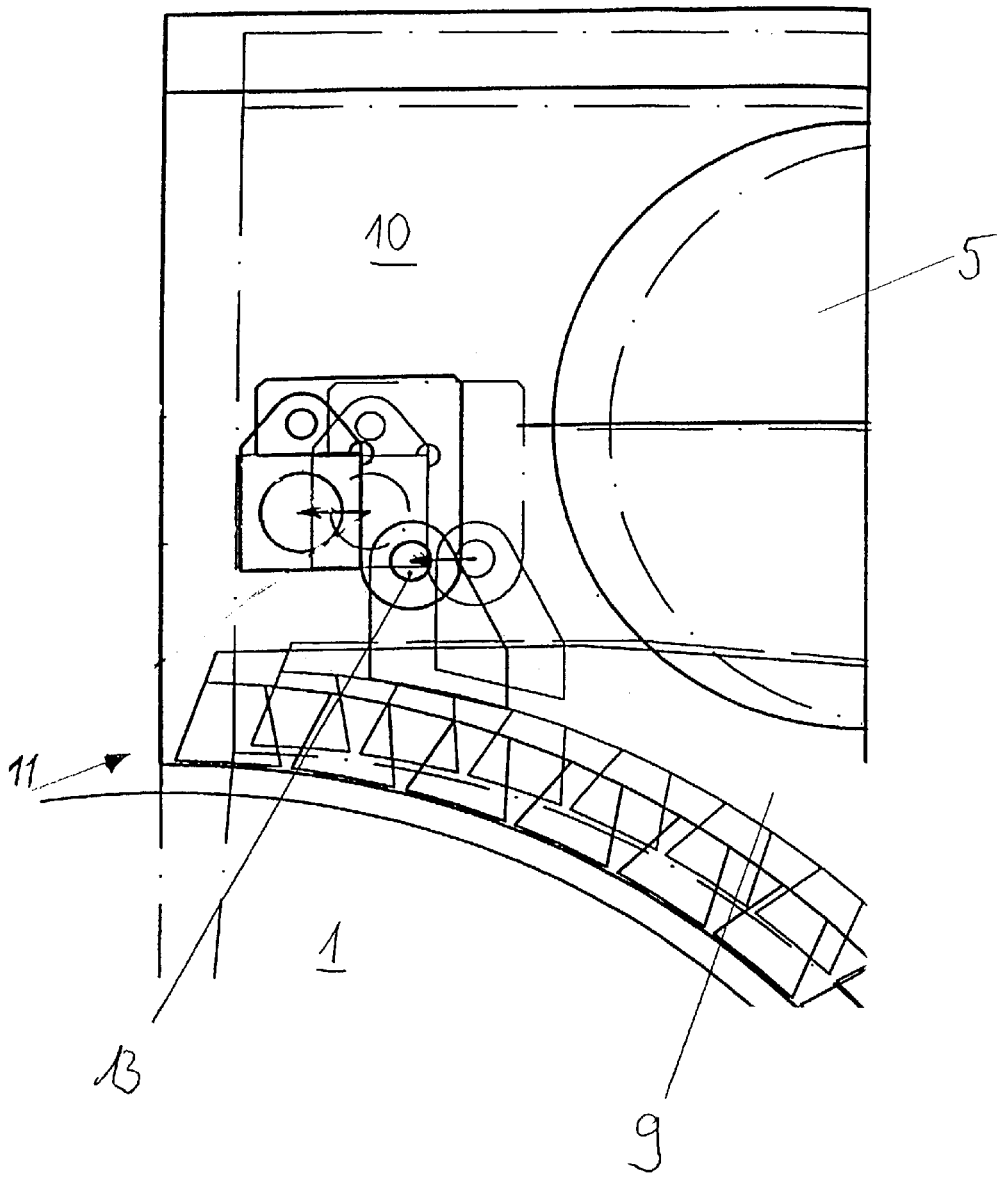
FIG. 6 shows the area of another support of the hood.

FIG. 6 shows the displacement of the upper bearing 13 on account of the expansion of the hood structure 10 and the displacement in the direction of the cylinder center. Hood structure 10 then draws the nozzle basket 9 along, over the pivotable joint 13. With this construction, the two expansions that act opposite each other are compensated.

As material for the structure, stainless steel (1.4571) or Corten A is normally used. Material giving suitable strength at these elevated temperatures is used for the nozzle basket, for instance 1.4835.

To minimise expansion perpendicular to the paper web, hood structure 10 is fixed on the drive side of the paper machine and nozzle basket 9 is fixed on the front side of the machine. Here also the expansion is minimised because of the fixture at different locations.

The invention claimed is:

1. Device for drying paper webs, especially tissue paper webs, with a dryer cylinder and a dryer hood having a hood frame with upper and lower portions and a nozzle basket within and extending between the upper and lower portions of the frame for blowing hot air onto the paper web, wherein the improvement comprises that the nozzle basket is uncoupled from the frame in that the nozzle basket is pivotally supported at the upper portion of the frame and slidingly supported at the lower portion of the frame.

2. Device according to claim 1 wherein the improvement comprises a drive unit and a gap sensor being provided for adjustment of the gap between the dryer cylinder and the dryer hood in operation.

3. Device according to claim 1 wherein the improvement comprises the gap between the dryer hood and the dryer cylinder is essentially uniform at all points in operation at hot air impingement temperatures, above 550° C.

4. Device according to claim 1, wherein the improvement comprises that the lower support is adjustable.

5. Device according to claim 1 wherein the device has a drive side adjacent one side of the web and a front side adjacent the perpendicularly opposed other side of the web, and the improvement comprises that the frame is fixed on the drive side and the nozzle basket is fixed on the front side.

* * * * *